US006125925A

United States Patent [19]

Obosu et al.

[11] Patent Number: 6,125,925

[45] **Date of Patent: *Oct. 3, 2000**

[54] HEAT EXCHANGER FIN WITH EFFICIENT MATERIAL UTILIZATION

[75] Inventors: Charles B. Obosu, Oklahoma City, Okla.; Alexander T. Lim, Brentwood; Craig B. Woodard, Franklin, both of Tenn.

[73] Assignee: International Comfort Products Corporation (USA), Nashville, Tenn.

[ * ] Notice: This patent is subject to a terminal disclaimer.

[21] Appl. No.: 09/029,137

[22] PCT Filed: Sep. 26, 1996

[86] PCT No.: PCT/US96/15447

§ 371 Date: Mar. 9, 1998

§ 102(e) Date: Mar. 9, 1998

[87] PCT Pub. No.: WO97/12191

PCT Pub. Date: Apr. 3, 1997

Related U.S. Application Data

[63] Continuation-in-part of application No. 08/534,274, Sep. 27, 1995, Pat. No. 5,660,230.

[51] Int. Cl.[7] ..... F28D 1/04

[52] U.S. Cl. ..... 165/151; 165/181

[58] Field of Search ..... 165/151, 181, 165/182

[56] References Cited

U.S. PATENT DOCUMENTS

| | | | |
|---|---|---|---|
| 3,916,989 | 11/1975 | Harada et al. | 165/151 |
| 4,550,776 | 11/1985 | Lu | 165/151 |
| 5,318,112 | 6/1994 | Gopin | 165/151 |
| 5,660,230 | 8/1997 | Obosu et al. | 165/151 |

FOREIGN PATENT DOCUMENTS

| | | | |
|---|---|---|---|
| 859865 | 12/1940 | France . | |
| 955196 | 1/1950 | France . | |
| 1209776 | 3/1960 | France | 165/151 |
| 2088106 | 1/1972 | France . | |
| 62-147290 | 7/1987 | Japan . | |
| 1 471 079 | 4/1977 | United Kingdom . | |
| 1 580 466 | 12/1980 | United Kingdom . | |

*Primary Examiner*—Leonard Leo
*Attorney, Agent, or Firm*—Baker & Daniels

[57] ABSTRACT

A heat exchanger (10) including a heat exchanger conduit and fins arranged on the conduit tubes (12, 12') to further heat transfer between the external fluid flowing over the fins (22, 22') and the fluid flowing within the conduit. The fins (22, 22') include a row of apertures through which tubes (12, 12') of the heat exchanger conduit extend. The leading (4, 6) and trailing (48) edges of the fins (22, 22') are contoured to substantially conform to isotherms around the circulating fluid flowing within the tubes (12, 12'). To achieve this edge configuration while also allowing for a dense packing of fins and tubes in a multi-row heat exchanger, the leading and trailing edges are wave-shaped such that adjacent fins can interfit together.

17 Claims, 3 Drawing Sheets

HEAT EXCHANGER FIN WITH EFFICIENT MATERIAL UTILIZATION

CROSS-REFERENCE TO RELATED APPLICATIONS

The present application is a continuation-in-part of U.S. patent application Ser. No. 08/534,274, filed Sep. 27, 1995, now U.S. Pat. No. 5,660,230, and assigned to the assignee of the present invention.

BACKGROUND OF THE INVENTION

The present invention relates to heat exchangers, and, in particular, to the geometry of fins utilized in conjunction with heat exchanger tubes for air conditioners and heat pumps.

Heat exchangers are used in a variety of refrigeration devices, such as air conditioners and heat pumps, to transfer energy between two mediums, e.g., a refrigerant fluid and ordinary air. The refrigerant fluid is circulated through relatively small diameter tubes, and air is passed over the exterior surfaces of the tubes so that heat may be transferred from the refrigerant fluid, through the material of the heat exchanger tubes, and to the air.

To provide a greater amount of surface area for contact with the air to increase the rate of heat transfer, thin metal sheets or fins are attached to the heat exchanger tubes. These fins typically include receiving apertures through which the tubes are insertably installed, and the metal material of the fins is securely held in thermal contact with the outer diametric portion of the tubes. By this thermal contact with the tubes, the fins conduct heat between the externally circulating air and the refrigerant fluid in the heat exchanger tubes. By forced convection produced by a fan system, heat is removed or transferred from the fins to the circulating air. To enhance the transfer of heat energy through the fins between the air and the refrigerant fluid, many fins have surface projections that accentuate the turbulence and mixing of the air passing across the fins. An assortment of different shaped protuberances and louver configuration are known which inhibit the growth of the air or fluid boundary layer formation on the fin surface, and which increase flow turbulence and flow mixing to improve heat transfer characteristics.

One shortcoming with many existing fins is that their designs result in an inefficient usage or wastage of the materials of construction, which in turn undesirably adds cost to the heat exchanger. For example, as disclosed in U.S. Pat. Nos. 5,170,842 and 4,907,646, many fins are generally rectangularly shaped when assembled in heat exchanging relationship around a row of heat exchanger tubes. For this fin shape, an appreciable amount of material used at a location both between adjacent tubes and offset from the row of tubes obtains only a relatively small increase in the heat exchanging capabilities of the fin. Consequently, if this fin material could be arranged at a location where its heat exchanging capabilities could be better exploited, a more efficient fin design would result. Other specialized fin designs, such as disclosed in U.S. Pat. No. 4,771,825, may result in undesirable amounts of scrap material or waste being produced during fin construction.

Another shortcoming of many existing fin configurations is exhibited when the stacked fins and tubes of a coil are bent or curved to conform to the desired shape of a heat exchanger. For example, heat exchangers may need to be formed in a cylindrical shape for use in outdoor air conditioning units. Especially for wider fins adapted for use in multi-row heat exchangers, the stacked fins have a tendency to become crushed together during their bending, thereby partially or possibly totally closing off the spacing between certain adjacent fins. This fin crushing is undesirable for a number of reasons, including that the heat transfer capabilities of the fins are compromised, and further that the overall aesthetics of visible fins is lessened.

Thus, it would be desirable to provide a heat exchanger which overcomes these and other shortcomings of the prior art

SUMMARY OF THE INVENTION

The present invention provides a heat exchanger with fins having upstream and downstream edges contoured to match the isotherms associated with the heat exchanger tubes, thereby avoiding the provision of extra fin material that adds little to the heat exchanging capabilities of the fin but nonetheless increases the cost of the fin. The fin design also maximizes the number of fins producible from a single is sheet of fin stock material, as well as allows for a dense packing of heat exchanger tubes in a multi-row coil. The louvers of the fin may also be radially arranged to take advantage of the isotherms of the fin.

The present invention provides comparable heat transfer as conventional fins while requiring a lesser amount of material. Also, by taking into account the fact that the louvers and enhancements on the fin surface, the tube-to-tube distance, and the temperature gradient between the fluid in the tube and the air effects the location of the isotherms, the present invention allows for optimal usage of fin material. The temperature gradient between the air and the fluid inside the tube along with the temperature difference between different tubes effects the shape of constant temperature lines—or isotherms. These isotherms are typically circular or elliptical in shape. The circular or elliptical shape suggests that much of the fin surface area has only a marginal or relatively small temperature differential with the air. These small surface areas are relatively ineffective and can be eliminated. The louvered fin surface creates elliptical isotherms, so that the fins may be cut as curves on the exterior of the fin or approximated by straight cuts. The present invention capitalizes on the advantages of plate fins, spine fins, and spiral fins by combining radial fin louvers with an exterior contour following the isotherms.

The louvers of the fin surface may be arranged radially about the tubes to promote the most efficient heat transfer. The radial arrangement of the louvers copies the arrangement of the desert cactus which has the best heat transfer convection in a spine or thin fin. This radial louver arrangement creates a high pressure drop across the fin surface, which can be minimized by the selective placement of the louvers about the tubes, with the louvers having an increased continuity from the densely packed heat exchangers. By compensating for the pressure drop increases with the positioning of the spine louvers in an adjacent, almost continuous arrangement, condensate is easily drained off the fin.

The present invention, in one form thereof, provides a heat exchanger which is arranged in the flow path of a fluid, such as air, and which includes at least one heat exchanger conduit and at least one fin. The heat exchanger conduit includes a plurality of tubes which contain a circulating fluid that typically is warmer than the flowing air. The tubes include first and second tubes which extend in a direction different from the air flow path and which are stacked in spaced apart relationship to define a tube row angled relative to the air flow path. At least one fin thermally engages the tubes and includes a leading edge, a body, and a trailing edge, with the leading edge located upstream of the body along the air flow path and the body in turn located upstream of the trailing edge along the air flow path. The body defines a plurality of apertures through which the conduit tubes extend. The leading edge and trailing edge are contoured to substantially conform to isotherms around the first and second tubes resulting from circulating fluid flowing within these tubes.

In another form thereof, the present invention provides a multi-row heat exchanger positionable in an air flow oriented in a first direction. The heat exchanger includes at least one heat exchanger conduit including a plurality of tubes containing a circulating refrigerant fluid. The tubes are arranged in at least two rows oriented generally transverse to the air flow. The tubes in each row are stacked in spaced apart relationship, and the tubes in one row are offset from the tubes in the adjacent row to be staggered relative to the air flow. The heat exchanger also includes at least one first fin and second fin mounted to the tubes of is a first and second row respectively. The fins each thermally engage the tubes of their respective rows and include a leading edge and a trailing edge relative to the air flow path. Each fin defines a plurality of apertures, and the leading edge and trailing edge of each fin is contoured to substantially conform to isotherms around the conduit tubes which extend through its apertures, wherein the isotherms result from refrigerant fluid flowing within the tubes.

An advantage of the isotherm-shaped fin involves the thickness of the boundary air layer. The boundary air layer grows as the distance from the edge increases. In a multi-row conventional heat exchanger where the tubes are staggered, the tubes located in the second row are disposed at a greater distance from the edge of the fin than the first row tubes. Correspondingly, the air boundary layer is thicker around the second row tubes—resulting in a less efficient heat exchange.

Another advantage of the present invention is that the heat exchanger fins are manufactured to have a compact configuration which utilizes the fin material in an efficient manner without significantly influencing heat exchange performance.

Still another advantage of the present invention is that the amount or waste or scrap produced in the manufacture of fins is desirably kept small.

Another advantage of the present invention is that the heat exchanger fins can be adapted to a curved arrangement in a multi-row heat exchanger with a reduced likelihood of damage during their curving.

Still another advantage of the present invention is that the contoured edge of the heat exchanger fins provides a distinctive and aesthetically pleasing look to the heat exchanger.

BRIEF DESCRIPTION OF THE DRAWINGS

The above mentioned and other advantages and objects of this invention and the manner of attaining them, will become more apparent and the invention itself will be better understood by reference to the following description of embodiments of the invention taken in conjunction with the accompanying drawings, wherein.

Figure 1:
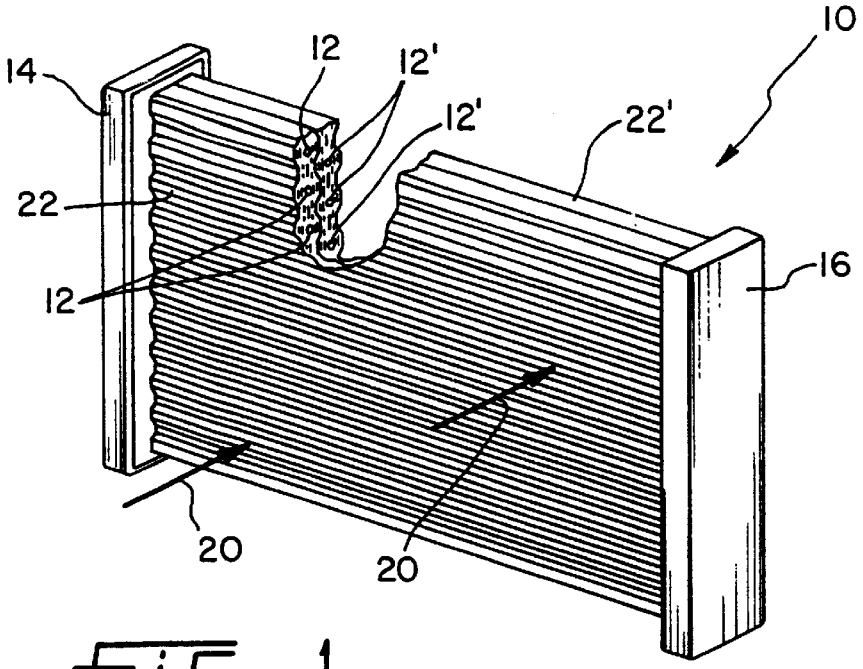
FIG. 1 is a perspective view, in partial cut-away, of a multi-row heat exchanger equipped with the compact cooling fins of the present invention.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE EXEMPLARY EMBODIMENTS

The embodiments disclosed below are not intended to be exhaustive or limit the invention to the precise forms disclosed below. Rather, the embodiments are chosen and described so that others skilled in the art may utilize their teachings.

With reference now to FIG. 1, the present invention relates to a heat exchanger or coil, generally designated 10. Heat exchanger 10 may be employed in a variety of machines or devices, such as within a central air conditioning unit where heat exchanger 10 functions as a condenser. A structure similar to heat exchanger 10 may also be used in an evaporator or a condenser, and may be located in the outdoor or indoor unit of an air conditioning or heat pump system. Consequently, while further described below in terms of its functionality as an air conditioner condenser, heat exchanger 10 may be applied to other applications as is well.

Heat exchanger 10 is illustrated as a multi-row heat exchanger, where multi-row refers to a construction in which the tubes through which the refrigerant fluid is circulated are arranged in multiple rows past which the cooling air flow is routed. In the shown embodiment, heat exchanger 10 comprises a generally planar arrangement, and includes a number of longitudinally extending heat exchanger tubes arranged in a pair of vertically aligned rows. These tubes for explanation purposes are designated 12 and 12' according to their respective rows. Tubes 12 and 12' are considered to form the refrigerant side of the heat exchanger and are made of 0.375 inch diameter copper tubes with wall thicknesses in the range of 0.011 inches and 0.016 inches. Tubes 12 and 12' can be smooth bored or enhanced, such as by providing a helical groove therein, to improve turbulence in the refrigerant to effect better heat transfer.

At their opposite ends, selected tubes 12, 12' are fluidly interconnected by reverse return bends (not shown) within manifolds 14, 16 to form one or more conduits through which refrigerant fluid is circulated. Tubes 12 and 12' are exposed to a flow of cooling air moving in the direction indicated at 20. Air flow path 20 is perpendicular to the longitudinally extending conduit tubes 12, 12' and passes between the stacked fins indicated at 22 and 22'. To enhance heat transfer rates, tubes 12 are vertically offset from tubes 12' so as to be arranged in a staggered relationship relative to air flow path 20 rather than an in-line relationship in which tubes 12 and 12' would be disposed at equal heights.

The specifics as to the connections between tubes 12, 12' to form the heat exchanger conduit(s) is not shown as it is well known in this art and not material to the present invention. Those of ordinary skill in the art will appreciate that a variety of differently circuited fluid conduits can be furnished with tubes 12, 12'. For example, the uppermost tube 12 and 12' in each of the tube rows in FIG. 1 may be supplied with refrigerant from a common supply source and may be in fluid communication only with the other tubes 12, 12' within their respective rows, and with the lowermost tubes in each row being ported to a common return line. For such an interconnection, two, parallel winding paths of refrigerant fluid are achieved. Alternatively, a single fluid circuit may be created by connecting the outlet of tube 12 with an inlet of tube 12'. Further, although tubes 12 and 12' are described as being separate pieces, a single tube may be formed into a row of tubes as used in a heat exchanger.

Figure 3:
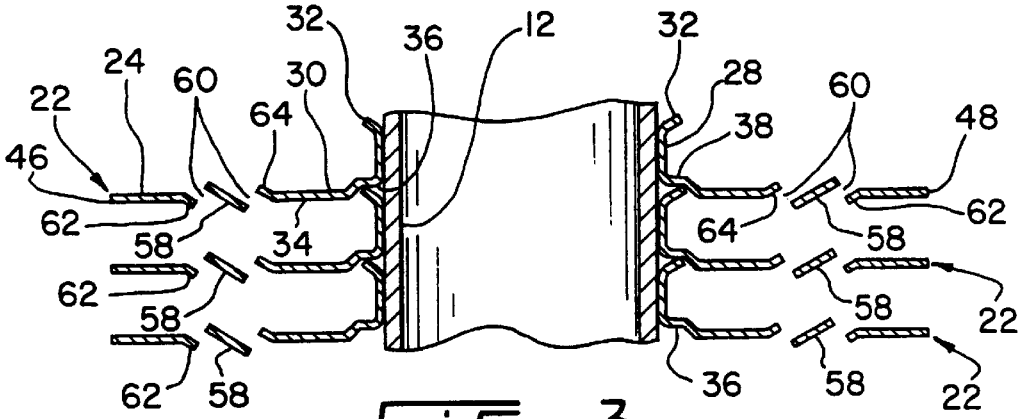
FIG. 3 is a cross-sectional view of the fin taken along line 3—3 in FIG. 2, wherein multiple stacked fins are shown, and wherein the refrigerant circulating tube of the heat exchanger is also shown in cross-section.
Figure 4:
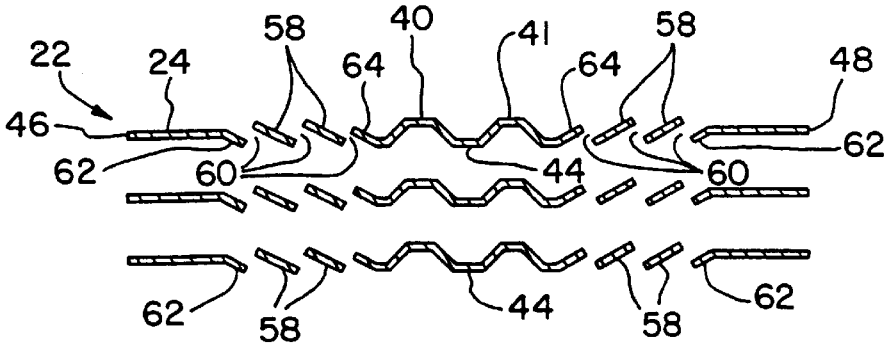
FIG. 4 is a cross-sectional view of the fin taken along line 4—4 in FIG. 2 wherein multiple stacked fins are shown.

Mounted on tubes 12 in a stacked arrangement as shown in FIGS. 3 and 4 is a series of plate-shaped fins 22, and a series of similarly shaped but vertically offset fins 22' are installed on tubes 12'. Fins 22 and 22' are generally considered to form the air side of the heat exchanger. Fins 22 are closely spaced apart along tubes 12 to provide narrow passageways for air to pass therebetween, and fins 22' are also closely spaced apart along tubes 12'. Fins 22, 22' function as thermal conduits between the refrigerant fluid in tubes 12, 12' and the cooling air at 20 which is conventionally forced over fins 22, 22' by fan action. Due to the similarity of their configurations, the following explanation of a fin 22 has equal application to the remainder of the fins 22 in the series as well as to the series of fins 22'.

Figure 2:
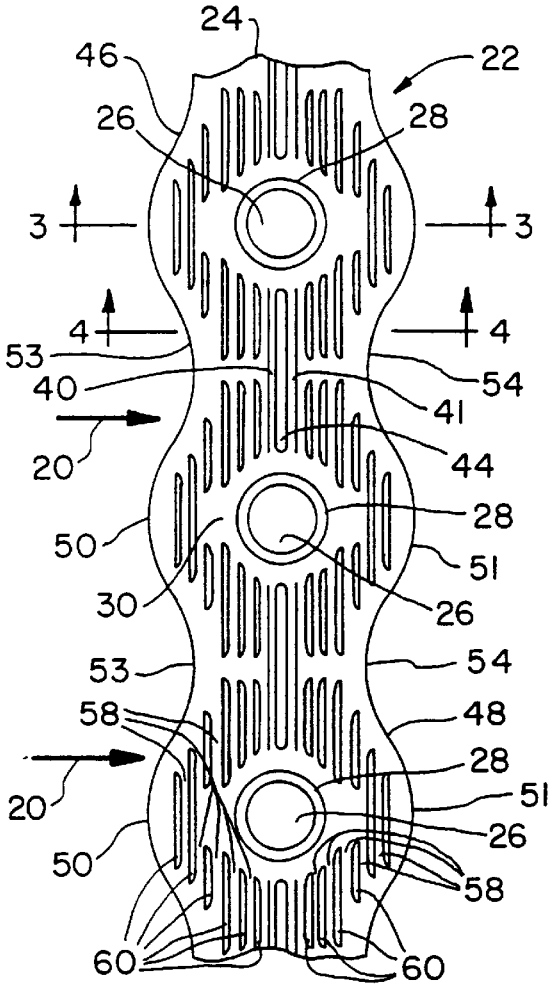
FIG. 2 is a fragmentary plan view of one configuration of a fin of the present invention removed from the remainder of the heat exchanger.

Referring now to FIG. 2, fin 22 is shown in fragmentary view removed from the remainder of heat exchanger 10. Fin 22 includes a generally planar fin body 24 which is arranged substantially parallel to air flow path 20. Fin body 24 includes a series of centrally located, linearly arranged circular apertures 26 through which tubes 12 are insertably installed. Apertures 26 are equally spaced from one another. As better shown in FIG. 3, spacing collars 28 ringing apertures 26 project from a first surface 30 of body 24 and terminate in a radially outwardly directed rolled lip portion 32. Collars 28 are in thermal or heat transferring contact with tubes 12. The bottom surface or underside 34 of fin body 24 is provided with an annular recess 36 into which the lip portion 32 of an adjacent fin 22 lockingly fits during heat exchanger assembly.

With additional reference to FIG. 4, at the base of each collar 28 are disposed raised ring portions 38 (see FIG. 3) which are spanned by ribs 40, 41 projecting from the plane of fin body 24 to form a double "dog-bone" support. Separating ribs 40, 41 along the middle portion of the rib length is a centrally disposed, inverted rib 44 jutting below the fin body plane, although alternatively inverted rib 44 may be coplanar with the fin body plane. Ribs 40, 41 and inverted rib 44 supply rigidity to fin 22 and further increase the local turbulence of the passing air flow to enhance heat transfer. Conceptually similar ribs are further described in co-pending U.S. patent application Ser. No. 08/229,628, filed on Apr. 19, 1994, which is incorporated herein by reference, which has issued as U.S. Pat. No. 5,509,469.

Fin body 24 extends between a leading edge 46 and a trailing edge 48. Although not shown, along their lengths which are oriented generally transverse to air flow path 20, leading edge 46 and trailing edge 48 are each continuously corrugated relative to the plane of fin body 24 to increase the rigidity of the edges. The midpoint of each louver is coplanar with fin body 24. The angle of the louvers is in the range of 20° to 35°, and in this embodiment is about 28°, and the distance between adjacent corrugations is about 0.062 inches. The thickness of the material of fin body 24 may range from 0.0035 to 0.0075 inches, with the exemplary embodiment having a thickness of 0.0040 inches.

Leading edge 46 and trailing edge 48 are contoured to generally correspond to the isotherms, i.e lines connecting points of the same temperature, associated with fin 22. It will be appreciated that the fin isotherms associated with a single tube of a heat exchanger generally assume the form of concentric circles around the tube. The louvered fin surface creates elliptical isotherms, which may be cut as curves on the exterior of the fin or approximated by straight cuts on the fin. Between pairs of tubes, the isotherms branch off from their circular configuration around each tube and assume a generally bowed path to the corresponding isotherm around the other of the tubes. The portion of a fin centered between the tubes and laterally offset from a line conceptually connecting the tubes is naturally heated the least by passage of fluid through tubes 12. The wave shapes of leading edge 46 and trailing edge 48 follow the general configuration of the isotherms produced by heat exchanger tubes 12 so as to exclude from the fin lesser heated regions often included in conventional fins.

In the embodiment of FIG. 2, the wave shape of the leading and trailing edges is generally sinusoidal with the crest portions 50, 51 of the waves located at the height of the heat exchanger tubes 12 and with the trough portions 53, 54 being centered at the midpoint of the distance between adjacent tubes 12. In the exemplary embodiment of FIG. 2. leading edge 46 and trailing edge 48 correspond to the sine curve, $y=\sin\Theta$. Leading edge 46 and trailing edge 48 are mirror images of one another as taken along a center line extending through the row of apertures 26. The crest portions of the leading edge of fins 22' are complementarily designed to fit into the spaces provided at the trough portions 54 of fins 22, and the crest portions 51 of trailing edge 48 fit into the trough portions of the leading edge of fins 22', thereby allowing a "dense packing" of the rows of tubes 12, 12' as shown in FIG. 1.

This arrangement tends to keep the tubes in an optimally spaced arrangement, i.e., the tubes of the same row are more efficiently spaced apart from tubes of adjacent rows, rather than the offset arrangement of rectangular fins. This allows for more tubes per surface area of fin 22, increasing the tube density. Additionally, the height of collar 28 may be decreased to pack more fins on the tubes, also increasing the amount of heat transfer surface per tube. One of ordinary skill in this art recognizes that additional rows of tubes with heat exchanger fins similar to fins 22 and 22' can be added to heat exchanger 10 in the dense packed, staggered tube arrangement shown if additional heat exchange capacity is desired. The isotherm configuration of fins 22 also allows for a greater number of tube rows to be disposed within a given space, as the thinner areas of one fin 22 interfits with the thicker areas of the adjacent fin 22' so that the combined width of the two row combination is less than the combined width of two rectangularly shaped conventional heat exchanger fins.

An additional benefit of the dense packing possible with the present invention involves the tubes situated in the second row of tubes. The reduced width of the regions between collars 28 minimizes the distance from the initial leading edge to the tubes of the second row, as compared to a conventional rectangular design wherein the second row tubes are about one and a half fin widths away from the edge. This arrangement results in the second row tubes being situated in a air boundary layer which is relatively smaller compared to the air boundary layer present at a second row tube in a conventional design.

Figure 5:
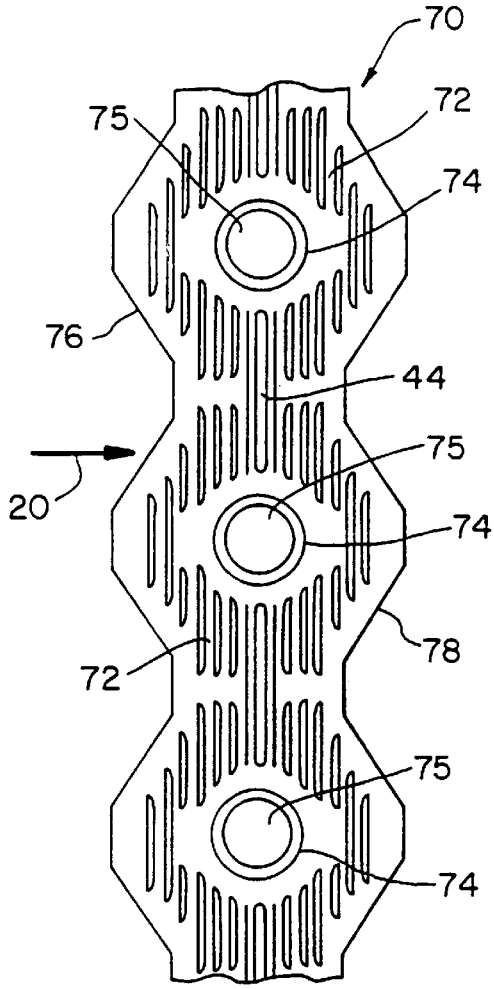
FIG. 5 is a plan view, conceptually similar to the view of FIG. 2, of a second embodiment of a fin of the present invention.
Figure 6:
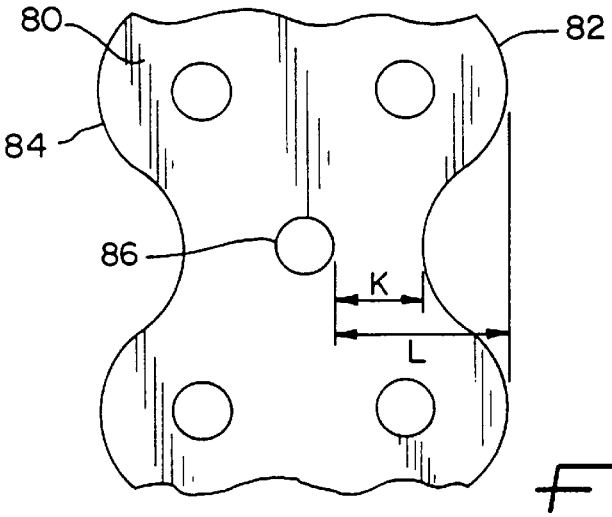
FIG. 6 is a plan view, conceptually similar to the views of FIGS. 2 and 5, of a third embodiment of a multi-row fin of the present invention.
Figure 7:
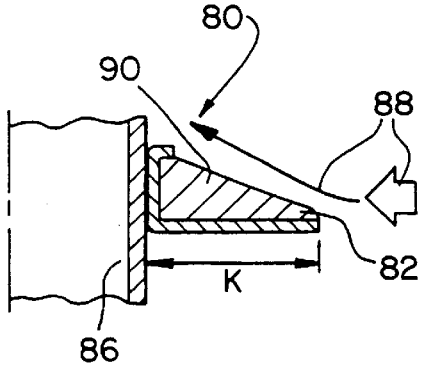
FIG. 7 is a cross-sectional view of the fin of FIG. 6 showing the air boundary layer.
Figure 8:
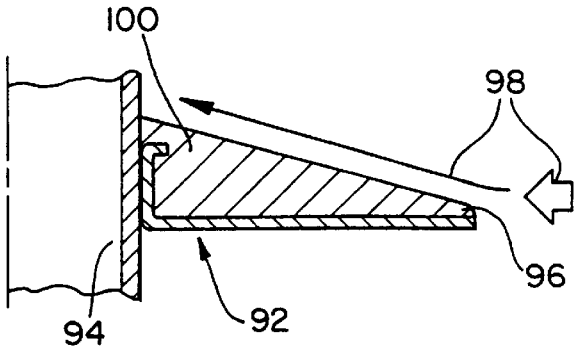
FIG. 8 is a cross-sectional view of a conventionally designed multi-row fin showing the air boundary layer.

The multi-row fin embodiment shown in FIG. 6 exemplifies this difference. Louvers and other surface enhancements are not shown in FIG. 5 for clarity. Fin 80 has leading edge 82 and trailing edge 84 with a contour similar to that shown in FIG. 2. Inner tube 86 is located at distance K from leading edge 82. In a conventional rectangular design, the inner tube would be located at least distance L from leading edge 82. FIGS. 7 and 8 shown the difference in air boundary layers for tubes being spaced from leading edge 82 by distances K and L, respectively. FIG. 7 shows fin 80 extending distance K from inner tube 86, with air stream 88 flowing over leading edge 82 to create air boundary layer 90. FIG. 8 shows conventional fin 92 extending distance L from inner tube 94 to leading edge 96 with air stream 98 flowing over leading edge 96 to create air boundary layer 100. The amount of tube surface disposed in air boundary layer 90 is significantly less than the amount of tube surface disposed in air boundary layer 100. Because the tubes have a greater heat exchange rate where contacting the flowing air stream than the relatively stationary air boundary layer, the efficiency of inner tube 86 of the present invention is greater than a similar tube disposed in an air boundary layer of a conventional design such as shown in FIG. 8.

Arranged along fin body 24 are a series of turbulence modules intended to limit the fluid boundary layer growth, and increase turbulence within the passing air flow to further increase heat transfer. Although additional types of modules, including raised lanced projections are known and may be employed, the modules incorporated into fin body 24 are louver type modules 58 which define slot-shaped openings 60 best shown in FIG. 2.

Slot-shaped openings 60 are arranged in alignment with the row of tubes 12 and therefore extend transversely to the air flow 20 and generally parallel to the leading edge 46 and trailing edge 48. The patterned arrangement of openings 60 is also generally coincident with the isotherms. As shown in the cross-sectional views of FIGS. 3 and 4, at any point along the length of fin 22, the openings 60 positioned farthest from the row of tubes 12 on either side of the tubes 12 are defined by louver sections 62, which are angled from the plane of fin body 24, and an adjacent louver 58 which is centered on the body plane. Similarly, the openings 60 closest to the row of tubes 12 are defined by louver sections 64, angled from the plane of fin body 24 in an opposite direction as louver sections 62, and an adjacent louver 58. Louvers 58, as well as louver sections 62, 64, are each disposed at an angle relative to the plane of body 24 in the range of 25° and 35°, and in this embodiment about 28°. For fm sizes in which the crest to crest width of fm 22 is about 1.082 inches and the trough to trough width of fin 22 is about 1.250 inches, each louver 58 has a width of approximately 0.062 inches and the widths of louver sections 62, 64 are each half the width of louver 58.

Referring now to FIG. 5 there is shown a second embodiment of a fin which is configured according to the principle of the present invention and removed from the remainder of a heat exchanger. The fin, generally designated 70, is is configured similarly to fin 22 in all respects except the specific contour of the leading and trailing edges. Consequently, explanation as to all of the other aspects of fin 70, such as louvers 72 and collars 74 which respectively correspond to louvers 58 and collars 28 of the embodiment of FIG. 2, will not be repeated.

Similar to the edges of the fin embodiment of FIG. 2, leading edge 76 and trailing edge 78 are contoured in a wave shape which generally corresponds to the isotherms created by refrigerant fluid flowing through conduit tubes inserted through apertures 75. Leading edge 76 and trailing edge 78 include a trapezoidal wave shape with crest portions being disposed about apertures 75 and trough portions centered between apertures 75. It will be appreciated that the complementary shapes of leading edge 76 and trailing edge 78 allow for a dense packing of staggered tube rows as described above.

Although two distinct variations of an isotherm based contour for a heat exchanger fin have been disclosed, other alternative wave-like contours are possibly. For example, a polygonal shaped design may be used such that each wave around each tube has four or five straight edges defining the wave shape.

For the embodiments disclosed above, the fins are manufactured out of a roll of stock metal material. In the exemplary embodiments, the fin material comprises an aluminum alloy and temper, such as 1100-H111. Other suitable materials include copper, brass, Cu pro-nickel, and material with similar properties. The fins may be formed in any standard fashion, such as in a single step enhancement die stage process with final cutting occurring at later stages of the overall process. In addition, while shown as a single piece, the fin could be constructed from multiple pieces within the scope of the invention.

Although illustrated in a multi-row heat exchanger, in certain applications it may be desirable to employ a heat exchanger with a single row of heat exchanger tubes 12 with fins 22. Further, instead of being used to form the planar design shown in FIG. 1, the tubes and fins can be bent or adapted to form differently shaped heat exchangers, for example a rounded design.

To form a planar heat exchanger, tubes are laced through the fin apertures. and then the tube ends are connected with reverse return bends to form a heat exchanger coil connectable to suitable refrigerant lines. For multi-row heat exchangers in which the heat exchanger requires a curved or angled shape, the fin stock material is still generally cut to form fins suitable for a single row of tubes. After tubes are laced through apertures in each of the fins to directly contact the fins, each row of tubes and its associated fins are separately adjusted or curved into a proper configuration. The curved rows of tubes with fins are then nested together, such as in the staggered relationship shown in FIG. 1, and the rows of tubes are interconnected as desired to form the heat exchanger conduits connectable to the refrigerant lines of the air conditioning system. Because in the present invention separate fins may be used to form the fins for different rows of tubes in a multi-row heat exchanger rather than a single set of wider fins, the likelihood of fin crushing during bending is believed to be advantageously reduced.

In still another alternate embodiment, the fin body could be constructed in a wave shape, such as a generally sinusoidal wave form or a more angular wave form such as a trapezoidal shape or other wave shape, mathematically so defined. Within each wave crest are located two apertures, and within each wave trough are located two apertures. The apertures within both the wave crests and wave troughs are all generally equidistant from a line which extends in the direction in which the wave propagates and which is centered between the peak of the crests and troughs.

The tubes passing through the wave shape fin may be connected to form conduits of a variety of different shapes. For example, the first and second tubes extending through the two apertures in a crest are at one end circuited with each other, for example through a reverse return bend. At their other ends, with return bends the first tube is circuited with a second type tube of the immediately preceding crest and the second tube is circuited with a first type tube of the immediately succeeding crest. The tubes in the trough sections of the fin are similarly circuited with each other.

Figure 9:
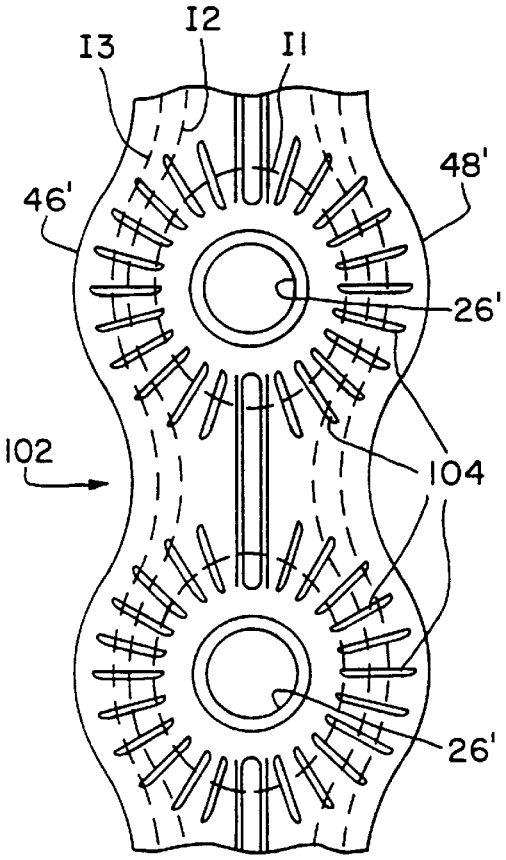
FIG. 9 is a fragmentary plan view of a spine configuration of a fin of the present invention removed from the remainder of the heat exchanger.
Figure 10:
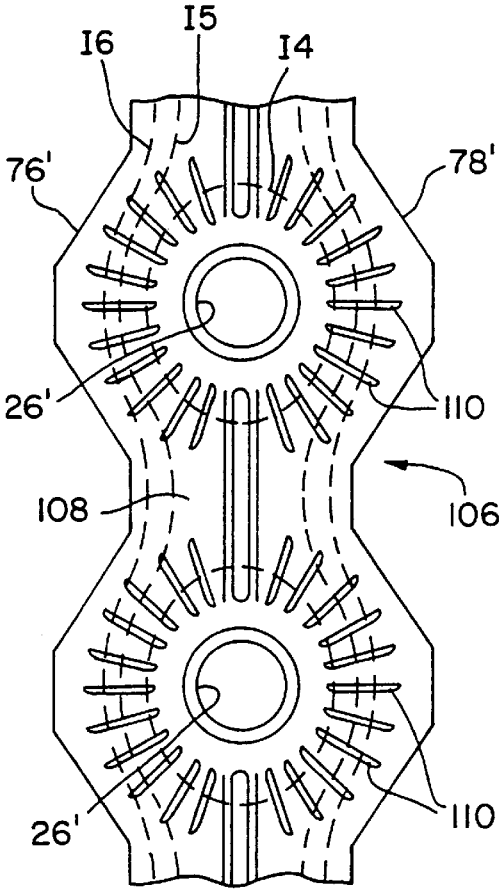
FIG. 10 is a fragmentary plan view of a second spine configuration of a fin of the present invention removed from the remainder of the heat exchanger.

FIGS. 9 and 10 show further embodiments of the present invention including spine fin arrangements. These embodiments take into account the fact that the louvers and enhancements on the fin surface, the between center points of the tubes (tube-to-tube distance), and the temperature gradient between the tube fluid and the air effects the location of the isotherms. The spine fin arrangement of FIGS. 9 and 10 maximizes the heat transfer of fin design, copying the arrangement of the desert cactus which has the best heat transfer convection in a spine or thin fin. The spine arrangement of the cactus provides heat transfer along the spine, with the spine ending at the point where the temperature differential approaches zero. This spine louver arrangement may create a high pressure drop in condensing applications, which can be minimized by the selective placement of the louvers about the tubes, with the louvers having an increased continuity from the densely packed heat exchangers. By compensating for the increased pressure drop with the positioning of the spine louvers in an adjacent, almost continuous arrangement, any condensate is easily drained off the fin. Thus, the present invention capitalizes on the advantages of plate fins, spine fins, and spiral fins by combining radial fin louvers with an exterior contour following the isotherms.

The arrangement of FIG. 9 has leading and trailing edges 46' and 48' which generally correspond to the similarly numbered edges of FIG. 2, except for the possible differences in the location of isotherms I1, I2, and I3 created by the spine fin structure. The outer perimeter of leading and trailing edges 46' and 48' are generally sinusoidal, but their exact shape is influenced by the internal temperature of the fluid within the tubes (relating to the application of the heat exchanger, e.g., as an evaporator or condenser) and by the tube-to-tube distance. Fin plate 102 includes spine louvers 104 which are arranged radially around apertures 26', each spine louver 104 extending in a radial direction away from the center of aperture 26'. Thus spine louvers 104 extend generally transversely to the isotherms, providing the most efficient heat transfer surface for fin plate 102.

The arrangement of FIG. 10 has leading and trailing edges 76' and 78' which generally correspond to the similarly numbered edges of FIG. 5, except for the possible differences in the location of isotherms I4, I5, and I6 created by the spine fin structure. The arrangement of straight edges, which approximate the curved isotherms, may be optimized for particular manufacturing requirements. In an exemplary embodiment of the invention, fin plate 106 is 0.866 inches wide around apertures 26', while bridge portions 108 have a thickness of 0.576 inches. This arrangement allows several fins to be cut from a coil of plate material, with each fin plate 106 having an effective width of 0.721 inches. Fin plate 106 includes spine louvers 110 which are arranged radially around apertures 26', each spine louver 110 extending in a radial direction away from the center of aperture 26'. Thus spine louvers 110 extend generally transversely to the isotherms, providing the most efficient heat transfer surface for fin plate 106.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

We claim:

1. A heat exchanger comprising: at least one heat exchanger conduit including a plurality of tubes for containing a circulating fluid, said plurality of tubes defining a tube row; and at least one fin thermally engaging said plurality of tubes and including a leading edge, a body, and a trailing edge, said body defining a plurality of apertures through which said plurality of conduit tubes extend, and at least one of said leading edge and said trailing edge is contoured to substantially conform to isotherms around said first and second tubes, characterized by a plurality of turbulence modules on said fin body, said turbulence modules comprise louvers radially aligned about one of said tubes.

2. The heat exchanger of claim 1 characterized in that said leading edge and said trailing edge each comprise a sine wave shape.

3. The heat exchanger of claim 1 characterized in that said leading edge and said trailing edge each comprise a trapezoidal wave shape.

4. The heat exchanger of claim 1 characterized in that said leading edge and said trailing edge are mirror imaged about said tube row.

5. The heat exchanger of claim 1 characterized in that said at least one fin comprises a plurality of fins mounted on said plurality of tubes in stacked relationship, and wherein each fin body comprises collars defining said apertures and spacing said fin body from an adjacent one of said fin bodies.

6. The heat exchanger of claim 5 characterized in that said fin bodies each comprise a first surface and an oppositely facing second surface, wherein said collars of each fin project from said first surface and include lips, and wherein said second surface of each fin comprises recesses into which said collar lips of an adjacent fin interfit.

7. The heat exchanger of claim 1 characterized in that each said fin of said at least one fin comprises a one-piece construction.

8. A multi-row heat exchanger positionable in an air flow oriented in a firs direction comprising: at least one heat exchanger conduit including a plurality of tubes for containing a circulating refrigerant fluid, said plurality of tubes defining at least a first row of said tubes and a second row of said tubes, said first and second row of said tubes each being oriented in a second direction generally transverse to the air flow, said tubes in said first row being disposed in spaced apart relationship, said tubes in said second row being disposed in spaced apart relationship and offset in said second direction from said tubes of said first row to be staggered relative to the air flow; at least one first fin thermally engaging said tubes of said first row and including a leading edge, a fin body, and a trailing edge, said first fin trailing edge located beyond said first fin leading edge in the first direction, said first fin defining a plurality of apertures through which said tubes of said first row extend, and one of said first fin leading edge and trailing edge is contoured to substantially conform to isotherms around said tubes in said first row; and at least one second fin thermally engaging said tubes of said second row and including a leading edges fin body and a trailing edge, said second fin tailing edge located beyond said second fin leading edge in the first direction, said second fin defining a plurality of apertures through which said tubes of said second row extend, and one of said second fin leading edge and trailing edge is contoured to substantially conform to isotherms around said tubes in said second row, characterized by a plurality of turbulence modules on each said fin body of said first and second fins, said turbulence modules comprise louvers, each of said louvers disposed coincidental with a radial line extending from the center of the adjacent one of said tubes.

9. The multi-row heat exchanger of claim 8 characterized in that said second fin leading edge is complementarily shaped to said first fin trailing edge to permit a dense packing of said first and second rows of tubes.

10. The multi-row heat exchanger of claim 9 characterized in that said leading and trailing edges of said first and second fins each comprise a wave shape including crests and troughs, and wherein crests of said first fin trailing edge fit within troughs of said second fin leading edge, and wherein crests of said second fin leading edge fit within troughs of said first fin trailing edge.

11. The multi-row heat exchanger of claim 10 characterized in that said wave shape comprises a sine wave shape.

12. The multi-row heat exchanger of claim 10 characterized in that said wave shape comprises a trapezoidal wave shape.

13. The multi-row heat exchanger of claim 9 characterized in said at least one first fin and said at least one second fin comprise louvers aligned along said second direction.

14. The multi-row heat exchanger of claim 9 characterized in that said at least one first fin comprises a plurality of fins stacked on said tubes of said first row of tubes, and wherein said at least one second fin comprises a plurality of fins stacked on said tubes of said second row of tubes.

15. A heat exchanger arranged in an air flow comprising: at least one heat exchanger conduit including a plurality of tubes for containing a circulating refrigerant fluid, said plurality of tubes being disposed in spaced apart relationship in a row oriented generally transverse to the air flow; and at least one fin thermally engaging said plurality of tubes and including a leading edge, a body, and a trailing edge, said body defining a plurality of apertures through which said plurality of tubes extend, said leading edge extending generally transverse to the air flow and including a wave shape contour, said trailing edge extending generally transverse to the air flow and including a wave shape contour, and said contours of said leading edge and said trailing edge are mirror images about said row of tubes, characterized by a plurality of turbulence modules on said fin body, said turbulence modules comprise louvers radially aligned about one of said tubes.

16. The heat exchanger of claim 15 characterized in that said wave shape of said leading and trailing edges comprises a sine wave shape.

17. The heat exchanger of claim 15 characterized in that said wave shape of said leading and trailing edges comprises a trapezoidal wave shape.

* * * * *

UNITED STATES PATENT AND TRADEMARK OFFICE

CERTIFICATE OF CORRECTION

PATENT NO. : 6,125,925

DATED : October 3, 2000

INVENTOR(S) : Charles B. Obosu, Alexander T. Lim and Craig B. Woodard

It is certified that error appears in the above-identified patent and that said Letters Patent is hereby corrected as shown below:

In the claims, in paragraph 11, line 5, changee "edges" to - -edge, a- -
in paragraph 11, line 6, change "tailing" to - -trailing- -

Signed and Sealed this

First Day of May, 2001

*Attest:*

Nicholas P. Godici

NICHOLAS P. GODICI

*Attesting Officer*

*Acting Director of the United States Patent and Trademark Office*